US009170548B2

(12) United States Patent
Takemoto

(10) Patent No.: US 9,170,548 B2
(45) Date of Patent: Oct. 27, 2015

(54) SHEET DISCHARGE DEVICE, AND IMAGE FORMING APPARATUS PROVIDED WITH THE SAME

(71) Applicant: KYOCERA Document Solutions Inc., Osaka-shi, Osaka (JP)

(72) Inventor: Mitsutoshi Takemoto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 22 days.

(21) Appl. No.: 13/945,129

(22) Filed: Jul. 18, 2013

(65) Prior Publication Data

US 2014/0029998 A1 Jan. 30, 2014

(30) Foreign Application Priority Data

Jul. 24, 2012 (JP) ..... 2012-163261

(51) Int. Cl.

| | |
|---|---|
| ***B65H 29/70*** | (2006.01) |
| ***G03G 15/00*** | (2006.01) |
| ***B65H 29/14*** | (2006.01) |
| ***B65H 29/52*** | (2006.01) |

(52) U.S. Cl.

CPC ..... *G03G 15/6552* (2013.01); *B65H 29/14* (2013.01); *B65H 29/52* (2013.01); *B65H 29/70* (2013.01); *B65H 2301/4212* (2013.01); *B65H 2301/51256* (2013.01); *B65H 2404/63* (2013.01); *B65H 2801/06* (2013.01)

(58) Field of Classification Search

CPC ..... G03G 2215/00704; G03G 15/6573; G03G 2215/00421; G03G 15/6552; B65H 29/70; B65H 2301/51214; B65H 2301/5122; B65H 2301/5121

USPC ..... 271/209, 161, 188; 399/405

See application file for complete search history.

(56) References Cited

U.S. PATENT DOCUMENTS

| | | | | |
|---|---|---|---|---|
| 2002/0038936 | A1 | 4/2002 | Fujisawa et al. | |
| 2006/0082047 | A1 * | 4/2006 | Fukatsu et al. | 271/220 |
| 2006/0239734 | A1 * | 10/2006 | Ohtsuki | 399/401 |

FOREIGN PATENT DOCUMENTS

| | | |
|---|---|---|
| JP | 2002-114423 | 4/2002 |
| JP | 2004-123395 | 4/2004 |

OTHER PUBLICATIONS

European Patent Appl. No. 13 003 698.1 Search Report dated Nov. 18, 2013.

* cited by examiner

*Primary Examiner* — Matthew G Marini
*Assistant Examiner* — Ruben Parco, Jr.
(74) *Attorney, Agent, or Firm* — Gerald E. Hespos; Michael J. Porco; Matthew T. Hespos

(57) ABSTRACT

A sheet discharge device includes a sheet discharge path, a discharge portion for discharging the sheet, and a pressing member. The pressing member is shiftable between a hanging posture, in which the pressing member hangs from an axis of pivotal movement thereof above the discharge path in such a manner as to block the discharge path, and a retracted posture, in which the pressing member is pivotally moved about the axis of pivotal movement in the sheet discharge direction for opening the discharge path. The pressing member has a side portion protruding into the discharge path in the hanging posture thereof, and a bottom portion continuing to a lower end of the side portion and extending toward downstream in the sheet discharge direction. The bottom portion includes an inclined surface inclined upwardly toward a middle part of the sheet in the sheet width direction in the hanging posture.

15 Claims, 14 Drawing Sheets

SHEET DISCHARGE DEVICE, AND IMAGE FORMING APPARATUS PROVIDED WITH THE SAME

This application relates to and claims priority from Japanese Patent Application No. 2012-163261 filed in the Japan Patent Office on Jul. 24, 2012, the entire disclosure of which is incorporated herein by reference.

BACKGROUND

The present disclosure relates to a sheet discharge device configured to discharge sheets onto a sheet tray, and an image forming apparatus provided with the sheet discharge device.

An image forming apparatus such as a copying machine, a printer, a facsimile machine, or a complex machine provided with the functions of these machines is provided with a sheet tray on which sheets each carrying an image are discharged. A sheet carrying an image is discharged onto a sheet tray by a discharge roller disposed above the sheet tray.

In the case where a sheet is curled, a trailing end of the sheet discharged from the discharge roller may be stuck on a wall surface below the discharge roller. In view of the above, there is known a technique such that a sheet is allowed to come into contact with an end of a plate-shaped member at a position inwardly away from widthwise ends of the sheet by a certain distance for pressingly contacting the sheet with the discharge roller. In the case where a sheet having a relatively small stiffness such as thin paper is passed, however, the sheet may be stuck by the plate-shaped member, or the sheet may be undulated due to pressing contact. Further, at the time of double-sided printing, an end of the plate-shaped member may come into pressing contact with an image surface of the sheet with a large force, which may result in poor image formation.

Further, in the background art shown in FIG. 14, a plate-shaped pressing member X1 is disposed to come into contact with the outer surface of a discharge roller X2 in a direction from above the discharge roller X2 obliquely downwardly in a sheet discharge direction. A trailing end of a sheet discharged from the discharge roller X2 is guided downwardly along the plate-shaped pressing member X1. However, in the above configuration, there is a space between the pressing member X1 and the discharge roller X2 at a position lower than the position where the pressing member X1 comes into contact with the discharge roller X2. As a result, if a sheet having an upwardly curled trailing end is discharged, the trailing end of the sheet enters the space between the pressing member X1 and the discharge roller X2. This may make it difficult or impossible to guide the trailing end of the sheet to a position below the discharge roller X2 by the pressing member X1. As a result, a next sheet P to be discharged may be guided to a position beneath the preceding sheet P. Further, in the case where a sheet having a downwardly curled leading end is discharged, the downwardly curled portion of the sheet may press the pressing member further downwardly. This may cause the leading end of the sheet to come into contact with the bottom portion of the sheet tray with a large angle. Consequently, the leading end of the sheet may be curled up on the sheet tray.

An object of the present disclosure is to provide a sheet discharge device that enables to discharge a sheet onto a sheet tray in a satisfactory manner, no matter in which direction the sheet is curled, and an image forming apparatus provided with the sheet discharge device.

SUMMARY

A sheet discharge device according to an aspect of the present disclosure is a sheet discharge device configured to discharge a sheet onto a sheet tray on which the sheet is to be placed. The sheet discharge device includes a discharge path, a discharge portion, and a pressing member. The discharge path is a path configured to discharge the sheet onto the sheet tray. The discharge portion is disposed on the discharge path, and is configured to discharge the sheet passing along the discharge path onto the sheet tray. The pressing member is disposed on a downstream side of the discharge portion in a sheet discharge direction, at a position corresponding to each of both ends of the sheet a sheet width direction orthogonal to the sheet discharge direction. The pressing member is shiftable between a hanging posture, in which the pressing member hangs from an axis of pivotal movement thereof above the discharge path in such a manner as to block the discharge path, and a retracted posture, in which the pressing member is pivotally moved in the sheet discharge direction about the axis of pivotal movement thereof for opening the discharge path. The pressing member has a side portion protruding into the discharge path in the hanging posture thereof, and a bottom portion continuing to a lower end of the side portion and extending toward downstream in the sheet discharge direction. The bottom portion includes an inclined surface inclined upwardly toward a middle part of the sheet in the sheet width direction in the hanging posture.

An image forming apparatus according to another aspect of the present disclosure is provided with an image forming assembly configured to form an image on a sheet, a sheet tray configured to place the sheet thereon, and a sheet discharge device configured to discharge the sheet having the image formed thereon by the image forming assembly onto the sheet tray. The sheet discharge device is provided with the above configuration.

These and other objects, features and advantages of the present disclosure will become more apparent upon reading the following detailed description along with the accompanying drawings.

DETAILED DESCRIPTION

Figure 1:
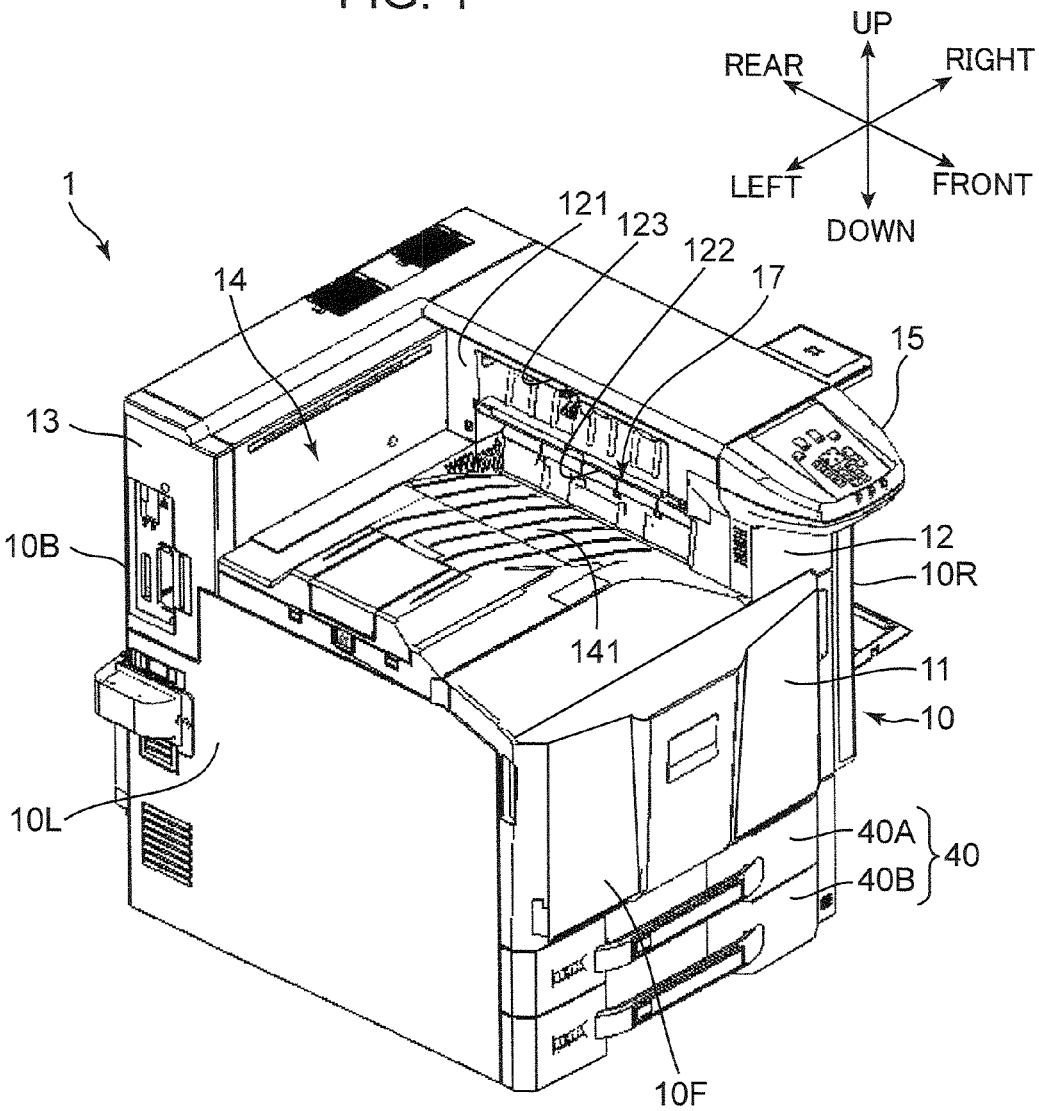
FIG. 1 is a perspective view of an image forming apparatus according to an embodiment of the present disclosure.

In the following, an embodiment of the present disclosure is described in detail referring to the drawings. FIG. 1 is a perspective view of an image forming apparatus 1 according to an embodiment of the present disclosure. In the embodiment, a copying machine is described as an example of the image forming apparatus 1. The image forming apparatus, however, may be a printer, a facsimile machine, or a complex machine provided with the functions of these machines.

The image forming apparatus 1 includes an apparatus body 10 having a substantially rectangular parallelepiped casing structure provided with a front surface 10F, a left surface 10L, a right surface 10R, and a back surface 10B. The apparatus body 10 includes a main housing 11, a right pillar portion 12 disposed upright on an upper right portion of the main housing 11, and a rear pillar portion 13 disposed upright on an upper rear portion of the main housing 11. The upper surface of the right pillar portion 12 and the upper surface of the rear pillar portion 13 are made flush with each other. A reading unit 25 and an automatic document feeder 20 (see FIG. 3) to be described later are mounted on the upper surfaces of the right pillar portion 12 and of the rear pillar portion 13. In FIG. 1, illustration of the reading unit 25 and of the automatic document feeder 20 is omitted.

Various components of the image forming apparatus 1 are housed in the main housing 11, in addition to an image forming assembly 30 (see FIG. 3) configured to perform image formation. A space or a region above the upper surface of the main housing 11, in which the right pillar portion 12 and the rear pillar portion 13 are not provided, is utilized as a sheet discharge portion 14 on which a sheet after image formation is discharged. The sheet discharge portion 14 is a space serving as an internal sheet discharge portion. The sheet discharge portion 14 is opened on the side of the front surface 10F and on the side of the left surface 10L of the apparatus body 10 in a state that the reading unit 25 and the automatic document feeder 20 are mounted.

A sheet tray 141 configured to receive a sheet after image formation is formed on the upper surface of the main housing 11. The sheet tray 141 is provided with an inclined surface gradually inclined downwardly from the left surface 10L toward an inner upright wall 121 of the right pillar portion 12. A first sheet discharge port 122 (discharge port) and a second sheet discharge port 123 are formed in the inner upright wall 121 of the right pillar portion 12 at a position facing the sheet discharge portion 14, for discharging a sheet after image formation to the outside of the apparatus body 10.

Figure 2:
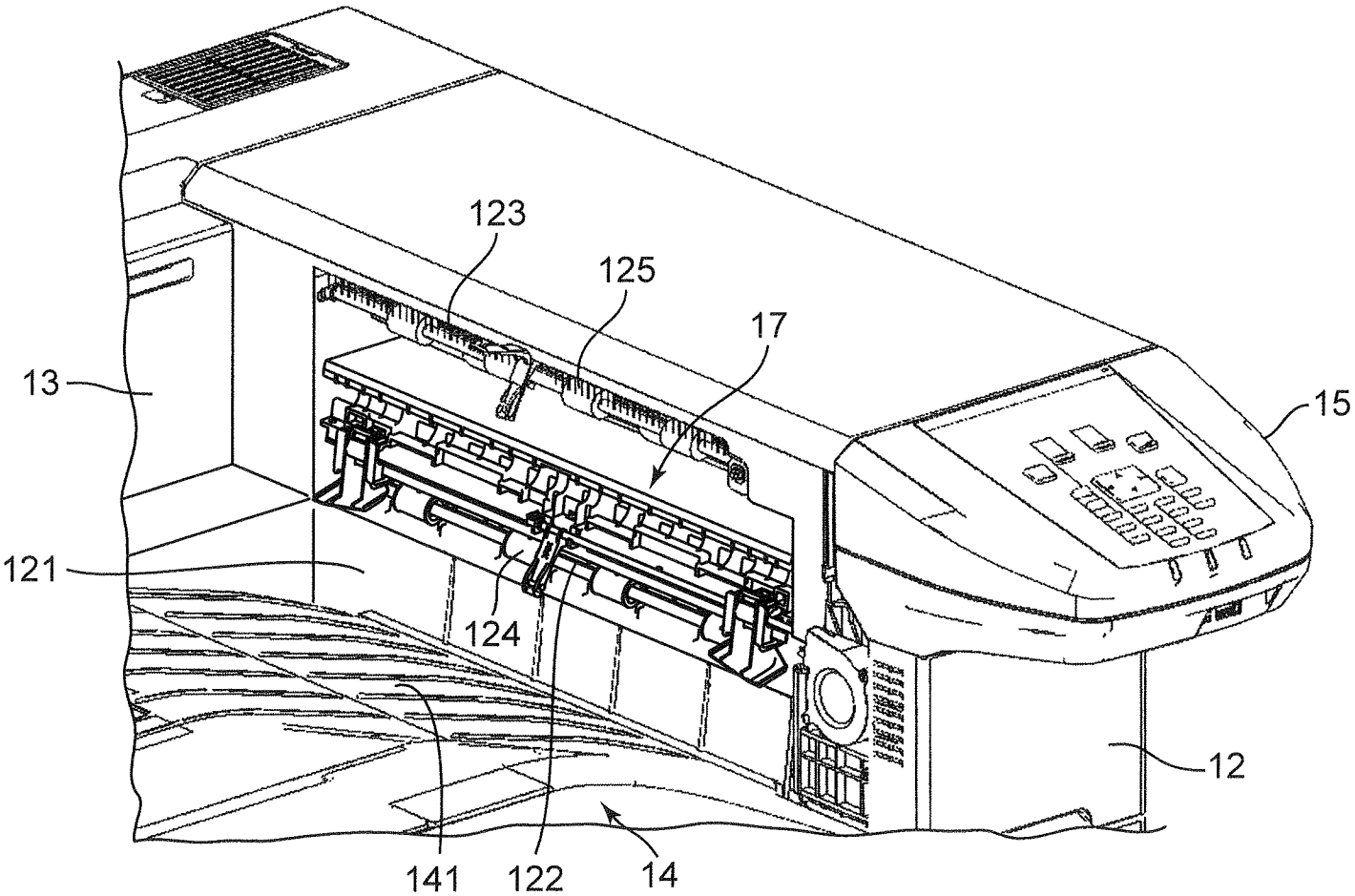
FIG. 2 is an enlarged perspective view showing the vicinity of a discharge port of the image forming apparatus.

FIG. 2 is an enlarged view showing the vicinity of the first sheet discharge port 122. There is disposed, in the vicinity of the sheet discharge port 122, a sheet discharge device 17 configured to apply a conveying force to a sheet for discharging the sheet onto the sheet tray 141 through the sheet discharge port 122. The sheet discharge device 17 includes discharge rollers 124 (discharge portion; first roller) configured to apply a conveying force to a sheet, and driven rollers 126 (second roller) to be described later.

A sheet discharged through the first sheet discharge port 122 by the discharge rollers 124 is received on the sheet tray 141. The user is allowed to put his/her hand into the sheet discharge portion 14 through the opening portion of the front surface 10F or through the opening portion of the left surface 10L for taking out a sheet after image formation from the sheet tray 141. The details of the sheet discharge device 17 are described later.

A discharge roller 125 is disposed near the second sheet discharge port 123. The second discharge port 123 is used in the case where a sheet is conveyed by a switchback mechanism, or in the case where an unillustrated upper tray (tray whose sheet receiving position is higher than that of the sheet tray 141) is additionally provided in the sheet discharge portion 14.

An operation portion 15 is disposed to project on an upper portion of a front surface of the right pillar portion 12. The operation portion 15 includes a numeric keypad and a start key, and is configured to receive an input indicating various operations/instructions from the user. The user is allowed to input the number of sheets to be printed, a printing density, and the like by way of the operation portion 15.

Figure 3:
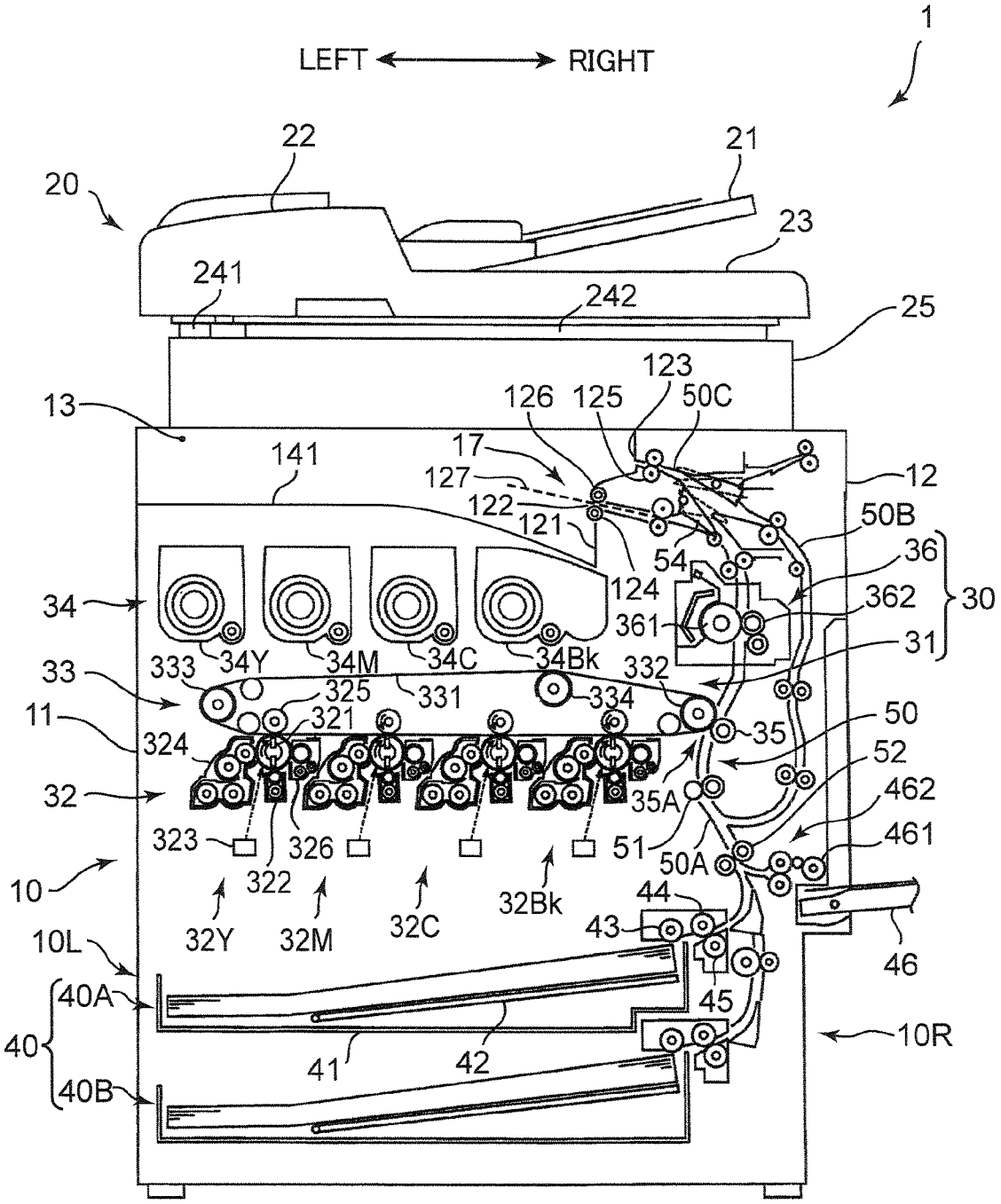
FIG. 3 is a cross sectional view showing an internal structure of the image forming apparatus.

Subsequently, an internal structure of the image forming apparatus 1 is described referring to FIG. 3. FIG. 3 is a cross sectional view schematically showing the internal structure of the image forming apparatus 1. The image forming apparatus 1 is provided with the apparatus body 10, the reading unit 25 mounted on the apparatus body 10, and the automatic document feeder 20 disposed above the reading unit 25.

The automatic document feeder 20 is configured to automatically feed a document sheet to be copied toward a predetermined document reading position (position where a first contact glass 241 is mounted). On the other hand, in the case where a document sheet is placed at a predetermined document reading position (position where a second contact glass 242 is mounted) by the user, the automatic document feeder 20 is opened upwardly. The automatic document feeder 20 includes a document tray 21 on which a document sheet is placed, a document conveying portion 22 configured to convey the document sheet via the automatic document reading position, and a document discharge tray 23 configured to discharge the document sheet after the image reading.

The reading unit 25 is configured to optically read an image of a document sheet through the first contact glass 241 for reading a document sheet to be automatically fed from the automatic document feeder 20 disposed on the upper surface of the apparatus body 10, or through the second contact glass 242 for reading a document sheet to be manually placed. A scanning mechanism including a light source, a moving carriage, and a reflection mirror; and an imaging element are housed in the reading unit 25. The illustration of these parts is omitted. The scanning mechanism is configured to irradiate light onto a document sheet, and to guide reflected light from the document sheet toward the imaging element. The imaging element is configured to photoelectrically convert the reflected light into an analog electric signal. The analog electric signal is converted into a digital electric signal by an A/D conversion circuit, and then, the digital electric signal is input to the image forming assembly 30.

The apparatus body 10 houses therein the image forming assembly 30 for forming an image on a sheet, a sheet storing portion 40 for storing sheets to be conveyed to the image forming assembly 30, and a conveying path 50 along which a sheet is conveyed from the sheet storing portion 40 to the sheet discharge port 122, 123 via the image forming assembly 30.

The image forming assembly 30 includes an imaging portion 31 for generating a toner image and transferring the toner image onto a sheet, and a fixing portion 36 for fixing the toner image on the sheet. The imaging portion 31 includes an image forming unit 32 constituted of four image forming units 32Y, 32Y, 32C, and 32Bk for respectively forming toner images of yellow (Y), magenta (M), cyan (C), and black (Bk), an intermediate transfer unit 33 disposed adjacent to and above the image forming unit 32, and a toner replenishing portion 34 disposed above the intermediate transfer unit 33 so as to form a full-color toner image.

Each of the image forming units 32Y, 32M, 32C, and 32Bk includes a photosensitive drum 321; and a charger 322, an exposure device 323, a developing device 324, a primary transfer roller 325, and a cleaning device 326 disposed around the photosensitive drum 321.

The photosensitive drum 321 is rotated about an axis thereof, and forms an electrostatic latent image and a toner image on the circumferential surface thereof. An example of the photosensitive drum 321 is a photosensitive drum made of an amorphous silicon (a-Si) based material. The charger 322 uniformly charges the surface of the photosensitive drum 321. The exposure device 323 has an optical system such as a laser light source, a mirror, and a lens. An electrostatic latent image is formed on the circumferential surface of the photosensitive drum 321 by irradiating light based on image data indicating a document image onto the circumferential surface of the photosensitive drum 321.

The developing device 324 supplies toner to the circumferential surface of the photosensitive drum 321 for developing an electrostatic latent image formed on the photosensitive drum 321. A two-component developer is used in the developing device 324. The developing device 324 includes agitation rollers, a magnetic roller, and a developing roller. The agitation rollers circulate and feed the two-component developer while agitating the two-component developer to thereby charge the toner. A layer of the two-component developer is formed on the circumferential surface of the magnetic roller, and a toner layer formed by transferring toner utilizing a potential difference between the magnetic roller and the developing roller is formed on the circumferential surface of the developing roller. The toner on the developing roller is supplied to the circumferential surface of the photosensitive drum 321, whereby the electrostatic latent image is developed.

The primary transfer roller 325 forms a nip portion with the photosensitive drum 321 in a state that an intermediate transfer belt 331 provided in the intermediate transfer unit 33 is interposed between the primary transfer roller 325 and the photosensitive drum 321 in order to transfer the toner image on the photosensitive drum 321 to the intermediate transfer belt 331. The cleaning device 326 is provided with a cleaning roller, and is configured to clean the circumferential surface of the photosensitive drum 321 after the toner image transfer.

The intermediate transfer unit 33 is provided with the intermediate transfer belt 331, a drive roller 332, a driven roller 333, and a tension roller 334. The intermediate transfer belt 331 is an endless belt wound around the rollers 332, 333, and 334. Toners from the respective photosensitive drums 321 are formed one over the other onto the outer surface of the intermediate transfer belt 331 (primary transfer). The drive roller 332 is a roller configured to apply a driving force for circulating the intermediate transfer belt 331. A secondary transfer roller 35 is disposed to face the circumferential surface of the drive roller 332. The nip portion between the drive roller 332 and the secondary transfer roller 35 serves as a secondary transfer portion 35A for transferring a full-color toner image formed on the intermediate transfer belt 331 onto a sheet. The driven roller 333 is a roller configured to be driven in accordance with the circulation of the intermediate transfer belt 331, and the tension roller 334 is a roller configured to apply a predetermined tension force to the intermediate transfer belt 331.

The toner replenishing portion 34 includes a yellow toner container 34Y, a magenta toner container 34M, a cyan toner container 34C, and a black toner container 34Bk. The toner containers 34Y, 34C, 34M, and 34Bk respectively store toners of the respective colors for supplying the toners of the respective colors to the developing devices 324 in the image forming units 32Y, 32M, 32C, and 32Bk corresponding to the colors of Y, M, C, and Bk via an unillustrated toner feeding path.

The fixing portion 36 includes a fixing roller 361 provided on the outer periphery thereof with a fixing belt to be heated by a conductive heating system, and a pressing roller 362 for forming a fixing nip portion by pressing contact with the fixing roller 361. A sheet having a toner image transferred by secondary transfer in the secondary transfer portion 35A undergoes a fixing process by application of heat and pressure thereto, while passing through the fixing nip portion. Thus, the toner image is fixed on the sheet surface.

The sheet storing portion 40 is provided with two sheet cassettes 40A and 40B each configured to accommodate sheets for image formation therein. The user is allowed to pull out the sheet cassettes 40A and 40B in forward direction from the front surface 10F of the apparatus body 10 (see FIG. 1). The sheet cassettes 40A and 40B are the cassettes provided for automatic sheet feeding. A sheet feeding tray 46 for manual sheet feeding is provided on the right surface 10R of the apparatus body 10. The sheet feeding tray 46 is mounted on the apparatus body 10 to be pivotally opened and closed around a lower end of the sheet feeding tray 46. In the case where manual sheet feeding is performed, the user opens the sheet feeding tray 46 shown in FIG. 3, and places a sheet or sheets on the sheet feeding tray 46.

The sheet cassette 40A (40B) is provided with a sheet accommodating portion 41 for accommodating a sheet stack or a stack of sheets, and a lift plate 42 for lifting up the sheet stack for sheet feeding. A pickup roller 43, and a pair of rollers constituted of a feeding roller 44 and a retard roller 45 are disposed above a right end of the sheet cassette 40A (40B). By driving the pickup roller 43 and the feeding roller 44, an uppermost sheet of the sheet stack in the sheet cassette 40A is fed one by one, and conveyed to an upstream end of the conveying path 50. On the other hand, a sheet placed on the sheet feeding tray 46 is conveyed to the conveying path 50 by driving a pickup roller 461 and a feeding roller 462 in the same manner as described above.

The conveying path 50 includes a main conveying path 50A along which a sheet is conveyed from the sheet storing portion 40, via the imaging portion 31, to a nip portion between the discharge rollers 124 and the driven rollers 126 in the sheet discharge device 17, an inverting conveying path 50B configured to return a sheet after one-sided printing to the imaging portion 31, in the case where double-sided printing is performed on the sheet, and a switchback conveying path 50C configured to feed a sheet from a downstream end of the main conveying path 50A to an upstream end of the inverting conveying path 50B.

A discharge path 127 along which a sheet is discharged onto the sheet tray 141 is formed near a terminal end of the main conveying path 50A. A branch guide 54 for switching between sheet conveying directions is disposed at a branch portion between the main conveying path 50A, the inverting conveying path 50B, and the switchback conveying path 50C.

A registration roller pair 51 is disposed on the upstream side of the main conveying path 50A than the secondary transfer portion 35A. Conveying a sheet is temporarily stopped by the registration roller pair 51 for skew correction. Thereafter, the sheet is fed to the secondary transfer portion 35A at a predetermined timing for image transfer. In addition to the above, conveying rollers 52 for conveying a sheet are disposed in the main conveying path 50A. The same configuration as described above is also applied to the conveying paths 50B and 50C.

Figure 4:
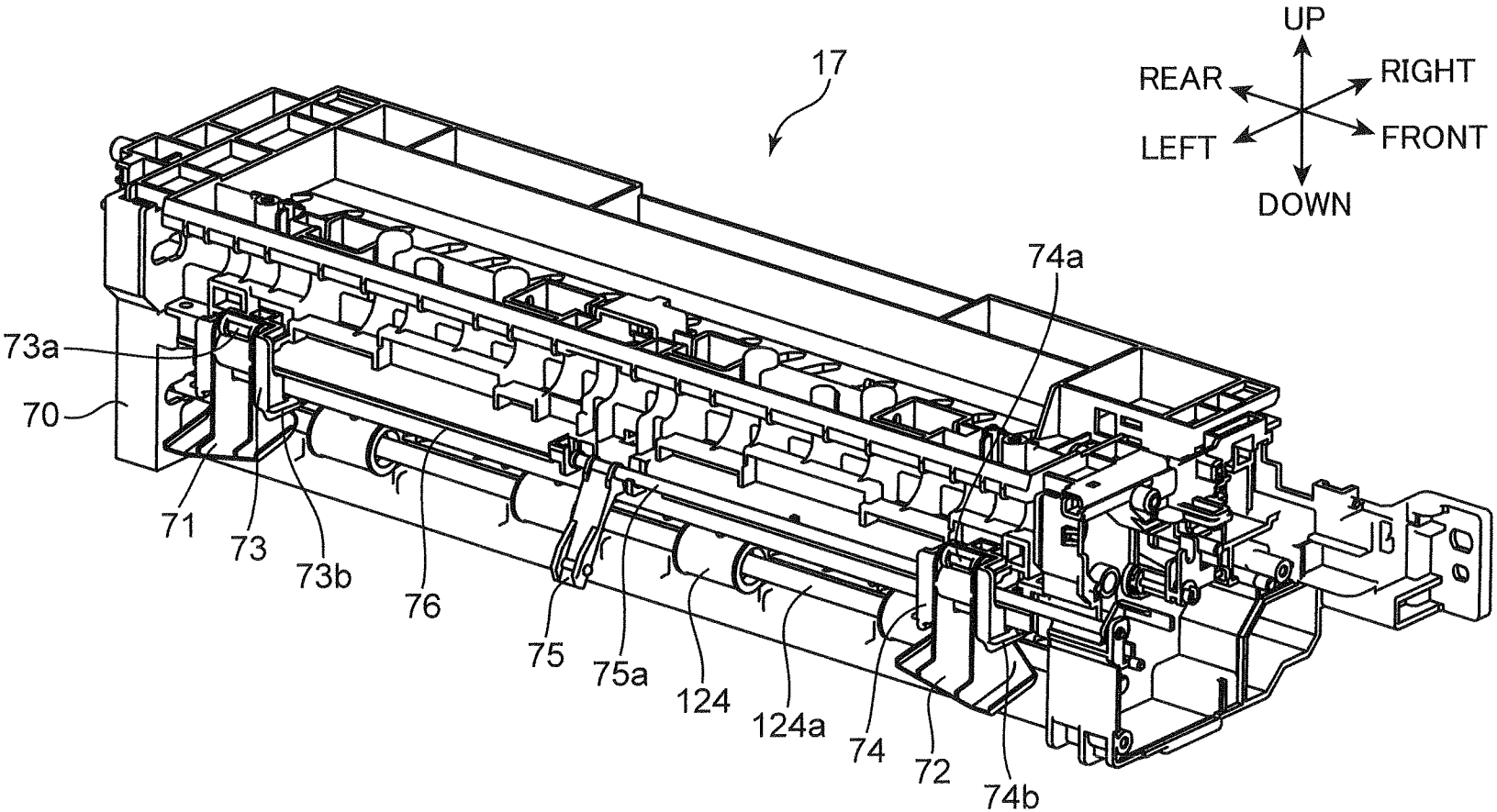
FIG. 4 is a perspective view of a sheet discharge device according to an embodiment of the present disclosure.
Figure 5:
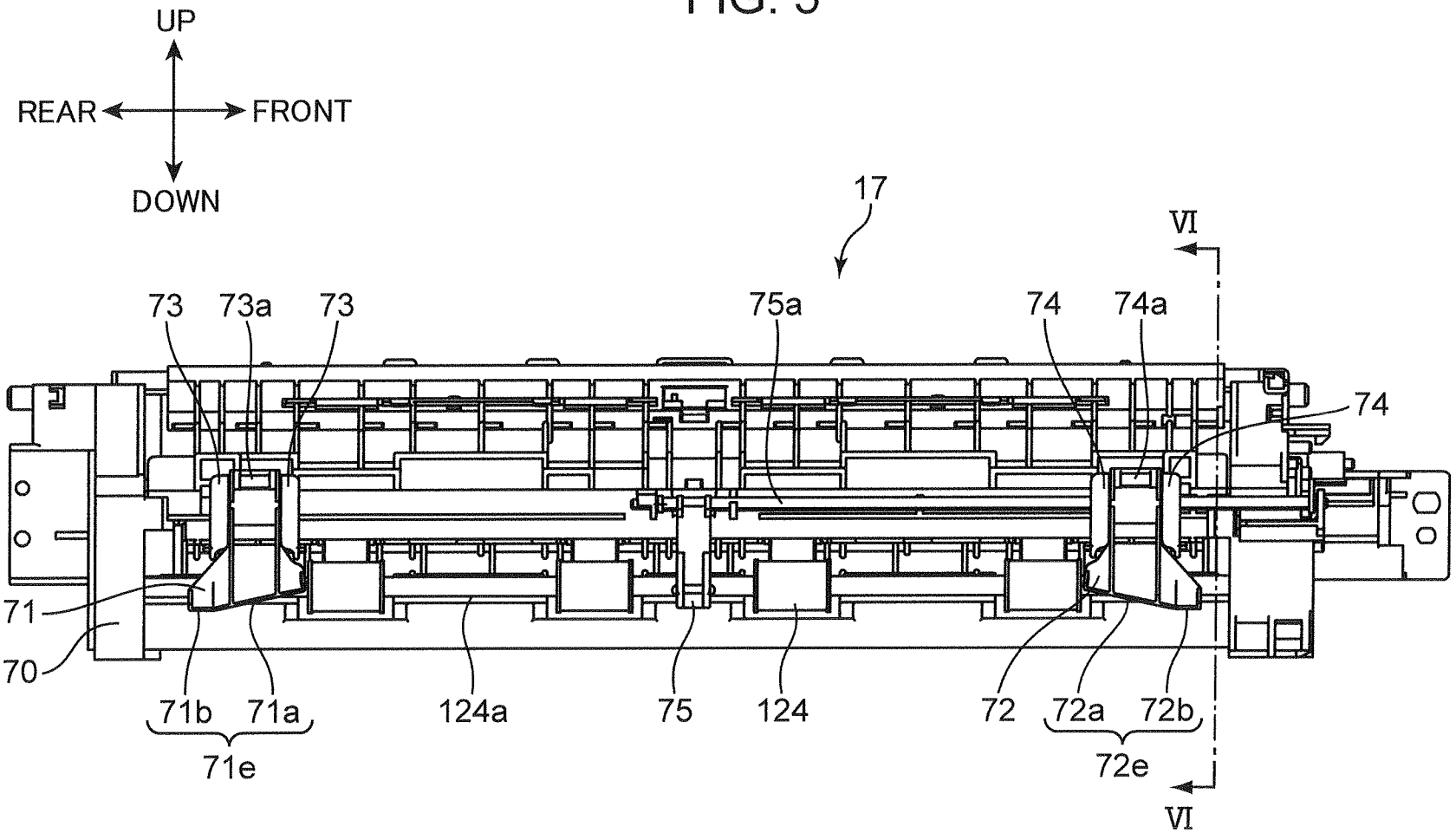
FIG. 5 is a front view of the sheet discharge device when viewed from the side of a first sheet discharge port.
Figure 6:
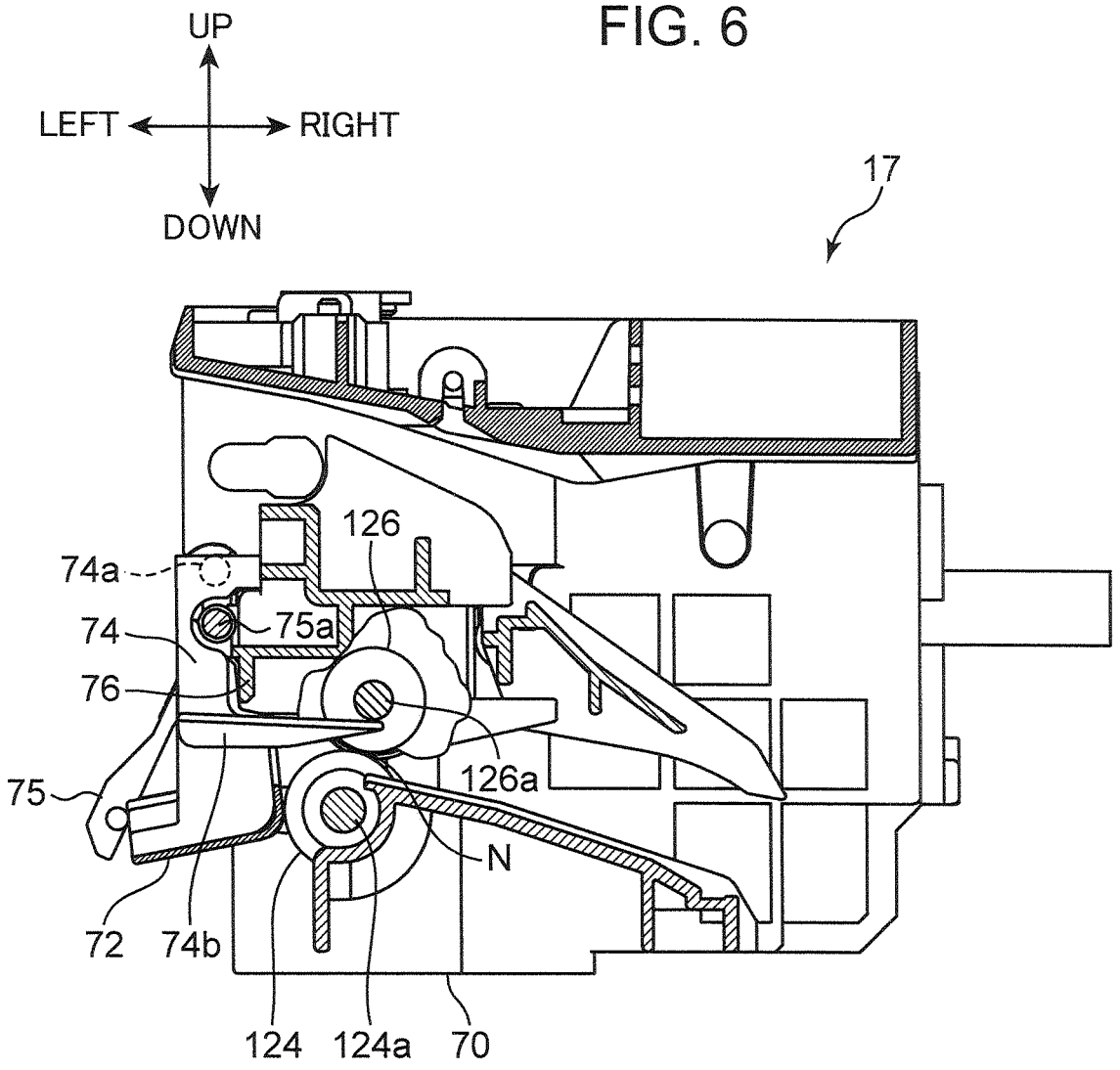
FIG. 6 is an elevational sectional view of the sheet discharge device.
Figure 7:
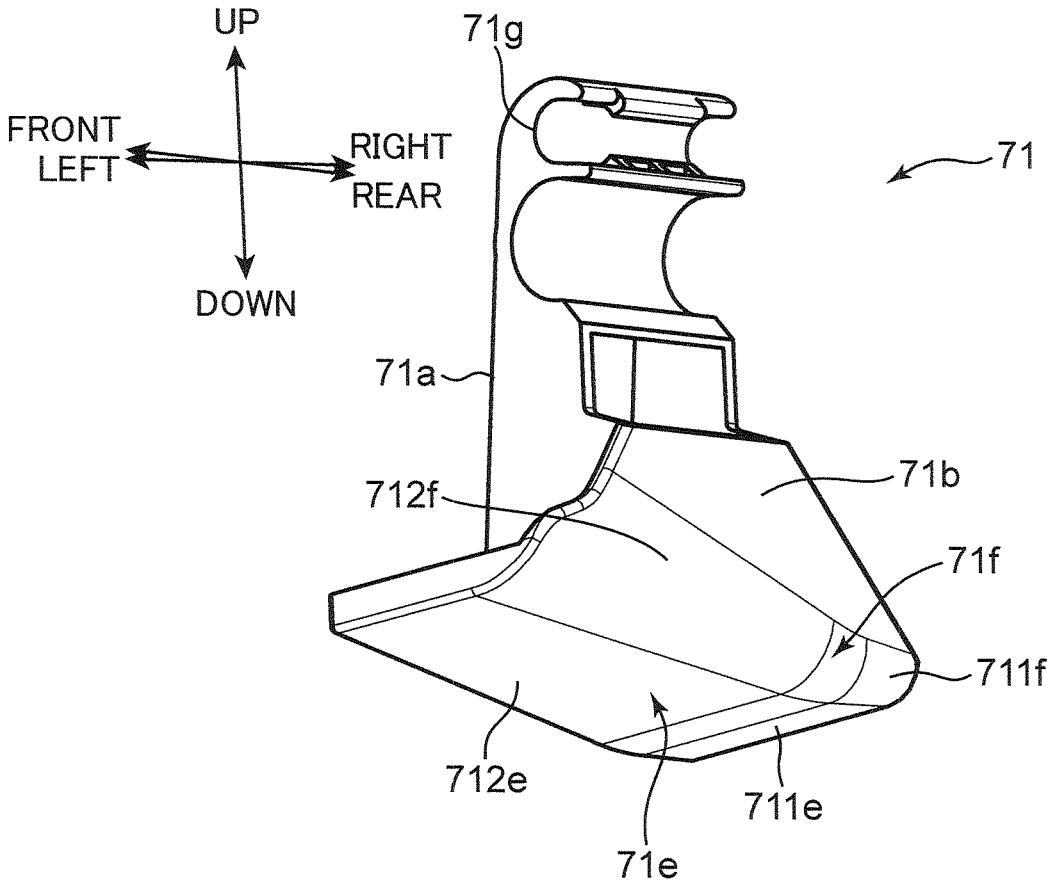
FIG. 7 is a perspective view showing a first pressing member shown in FIG. 4.
Figure 8B:
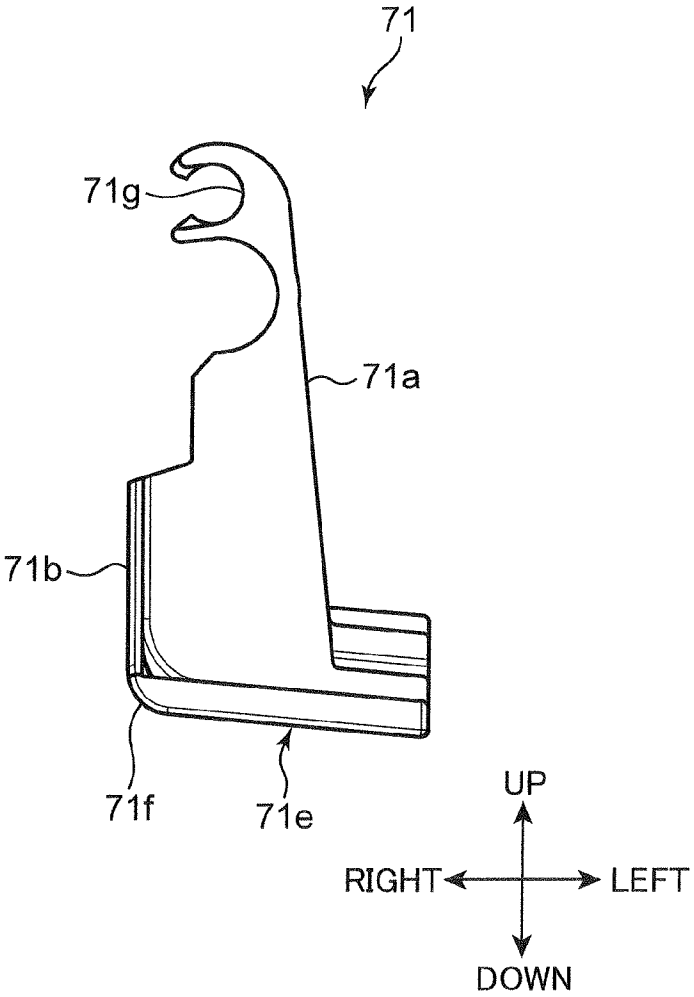
FIG. 8B is a side view of the first pressing member.
Figure 9:
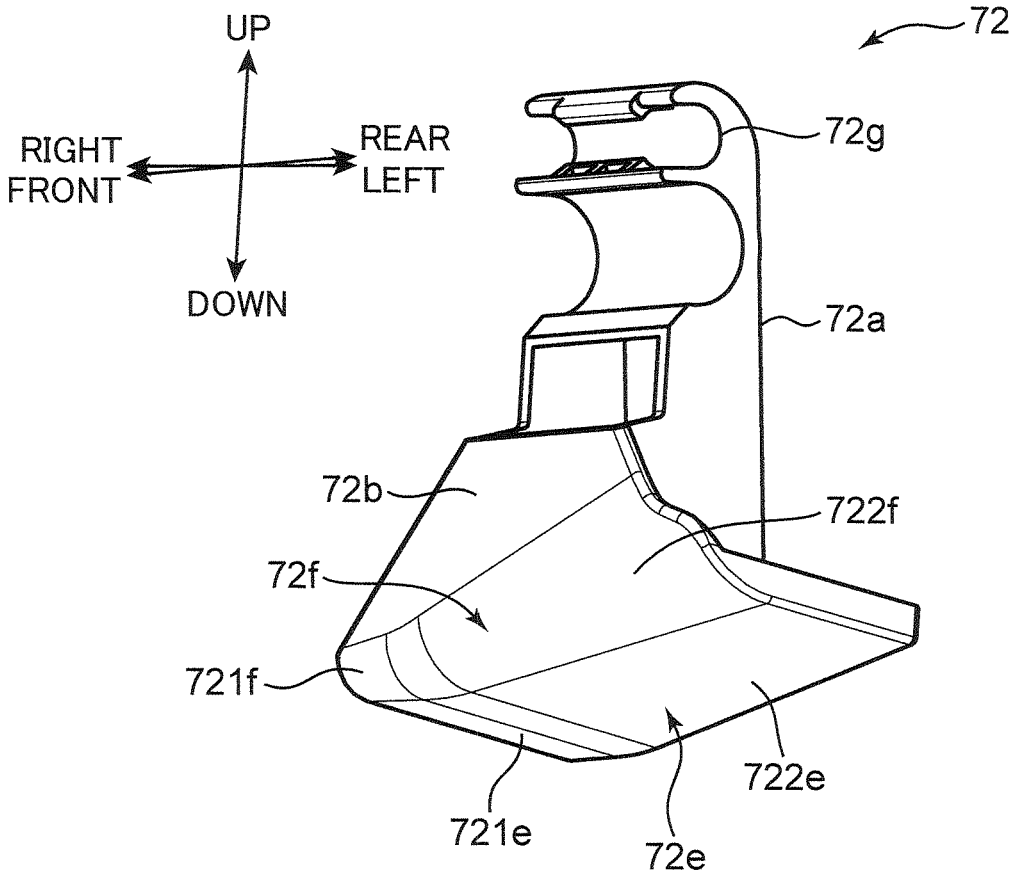
FIG. 9 is a perspective view showing a configuration of a second pressing member shown in FIG. 4.
Figure 10B:
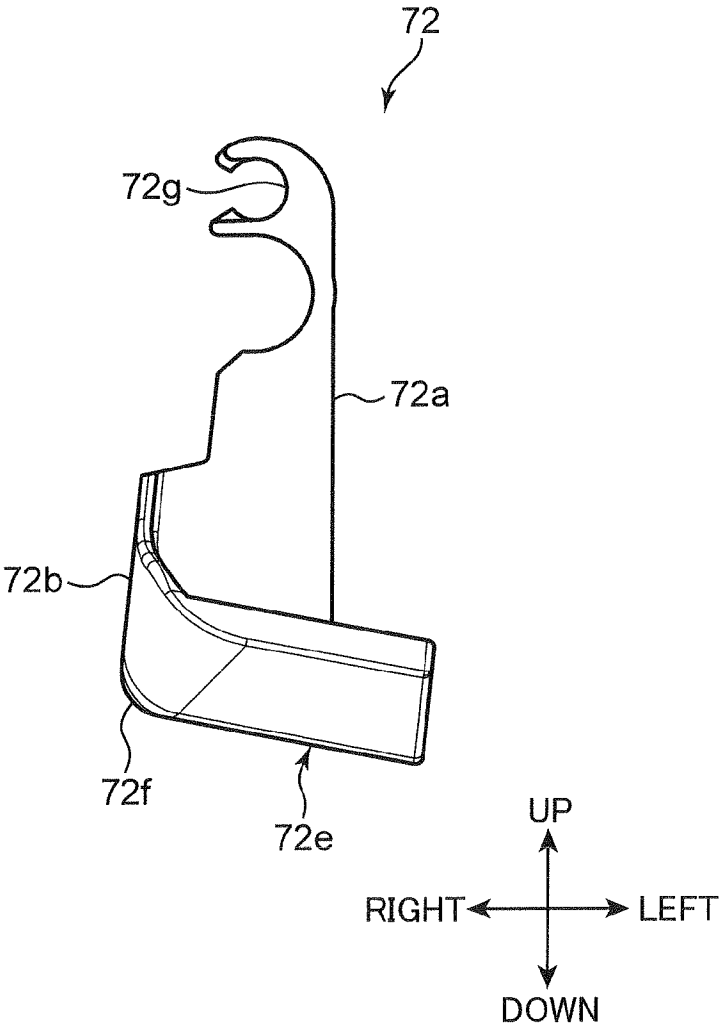
FIG. 10B is a side view of the second pressing member.

In the following, the configuration of the sheet discharge device 17 according to an embodiment of the present disclosure is described in detail referring to FIGS. 4 to 10B. FIG. 4 is a perspective view of the sheet discharge device 17, FIG. 5 is a front view of the sheet discharge device 17 when viewed from the first sheet discharge port 122 side, FIG. 6 is an elevational sectional view of the sheet discharge device 17, FIGS. 7 to 8B are diagrams showing a first pressing member 71, and FIGS. 9 to 10B are diagrams showing a second pressing member 72.

The sheet discharge device 17 is a device configured to discharge a sheet onto the sheet tray 141. The sheet discharge device 17 includes the discharge rollers 124 (first roller), the driven rollers 126 (second roller), a rotary shaft 124*a*, rotary shafts 126*a*, the first pressing member 71 (pressing member), the second pressing member 72 (pressing member), a first attachment auxiliary member 73, a second attachment auxiliary member 74, an actuator 75, a support shaft 75*a*, an electrostatic remover 76, and a frame 70 for holding these members.

The rotary shaft 124*a* has both ends thereof supported by the frame 70, and extends in front and rear directions (direction orthogonal to the sheet discharge direction). The discharge rollers 124 are fixedly and coaxially mounted on the rotary shaft 124*a*, and are rotated in association with the rotation of the rotary shaft 124*a* about an axis thereof. Referring to FIG. 5 and FIG. 6, the rotary shafts 126*a* are shafts extending in front and rear directions. The rotary shafts 126*a* are disposed in correspondence to the arrangement positions of the respective corresponding discharge rollers 124. The driven rollers 126 are pivotally supported by the rotary shafts 126*a*. Each of the driven rollers 126 is disposed to face the corresponding discharge roller 124 at a position above the discharge roller 124. The driven rollers 126 form a nip portion N with the discharge rollers 124.

When the rotary shaft 124*a* is driven and rotated by an unillustrated drive motor, the discharge rollers 124 are rotated in association with the rotary shaft 124*a*, and the driven rollers 126 are rotated together with the discharge rollers 124. By the above operation, the discharge rollers 124 and the driven rollers 126 convey a sheet conveyed along the main conveying path 50A (sheet passing along the discharge path) in left direction (sheet discharge direction), while nipping the sheet therebetween, and discharges the sheet onto the sheet tray 141.

The discharge rollers 124 and the driven rollers 126 correspond to an example of a discharge portion. The discharge portion, however, is not necessarily limited to the discharge portion constituted of the discharge rollers 124 and the driven rollers 126. For instance, the discharge portion may be constituted of the discharge rollers 124, and members opposing to the discharge rollers 124 in place of the driven rollers 126.

The actuator 75 is a detecting piece configured to detect a sheet passing through the first sheet discharge port 122. The actuator 75 is mounted on one end side of the support shaft 75*a* which is pivotally supported on the frame 70. An unillustrated sheet detecting sensor is disposed on the other end side of the support shaft 75*a*.

The electrostatic remover 76 is a plate-shaped member which is disposed above the discharge rollers 124 and extends in parallel to the discharge rollers 124 on the left side of the driven rollers 126 (on the side corresponding to the sheet discharge direction). The electrostatic remover 76 is fixedly mounted on the frame 70 by a screw or a double-sided adhesive tape, for instance.

A conductive sheet such as an aluminum foil or a metal sheet is attached to the surface of the electrostatic remover 76. The conductive sheet is grounded. Although not shown, bundles of conductive fibers each formed by bundling conductive elements in the form of fibers are attached to the conductive sheet at a predetermined interval. The conductive fiber bundles are disposed to traverse the discharge path along which a sheet is discharged by the discharge rollers 124. With the above configuration, the sheet discharged by the discharge rollers 124 comes in contact with or comes in close contact with the conductive fiber bundles, and static electricity on the sheet is removed from the sheet, while being guided from the conductive fiber bundles to the electrostatic remover 76.

The first attachment auxiliary member 73 is provided with a pivot shaft 73*a* configured to pivotally support the first pressing member 71, and a guide rib 73*b* configured to guide the leading end of the sheet in the sheet discharge direction toward a predetermined contact position of the first pressing member 71. Likewise, the second attachment auxiliary member 74 is provided with a pivot shaft 74*a* configured to pivotally support the second pressing member 72, and a guide rib 74*b* configured to guide the leading end of the sheet in the sheet discharge direction toward a predetermined contact position of the second pressing member 72.

Figure 8A:
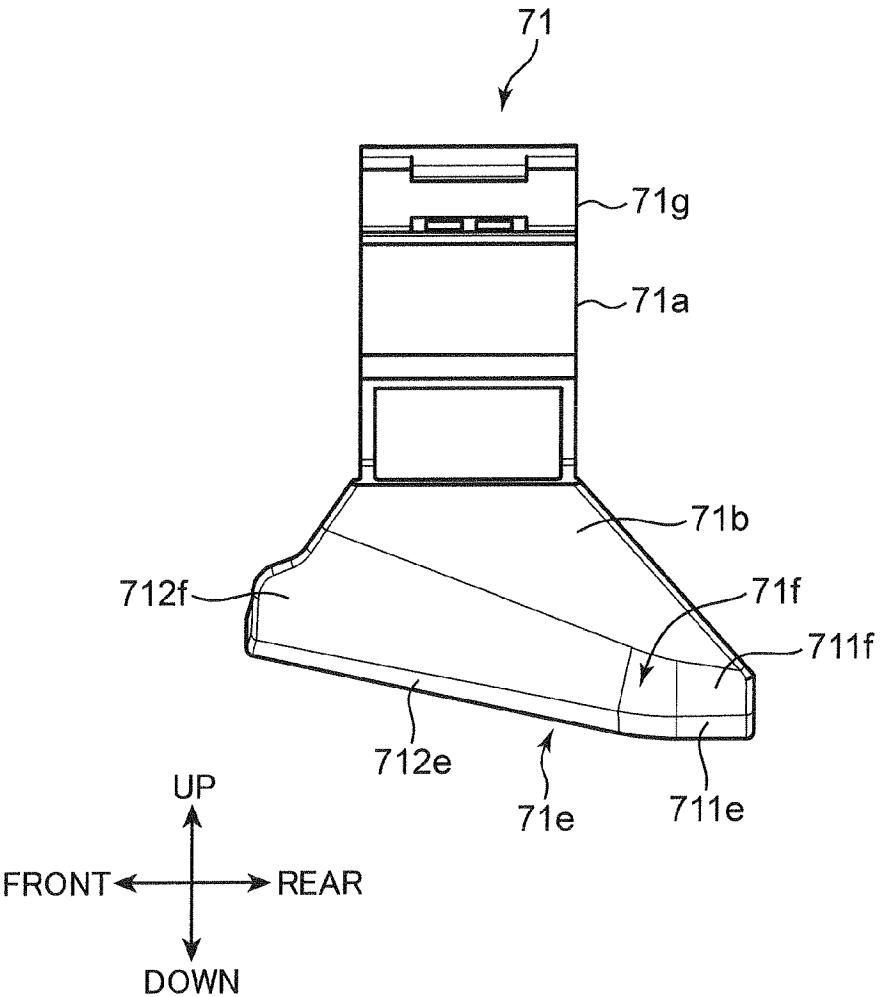
FIG. 8A is a rear view of the first pressing member.
Figure 10A:
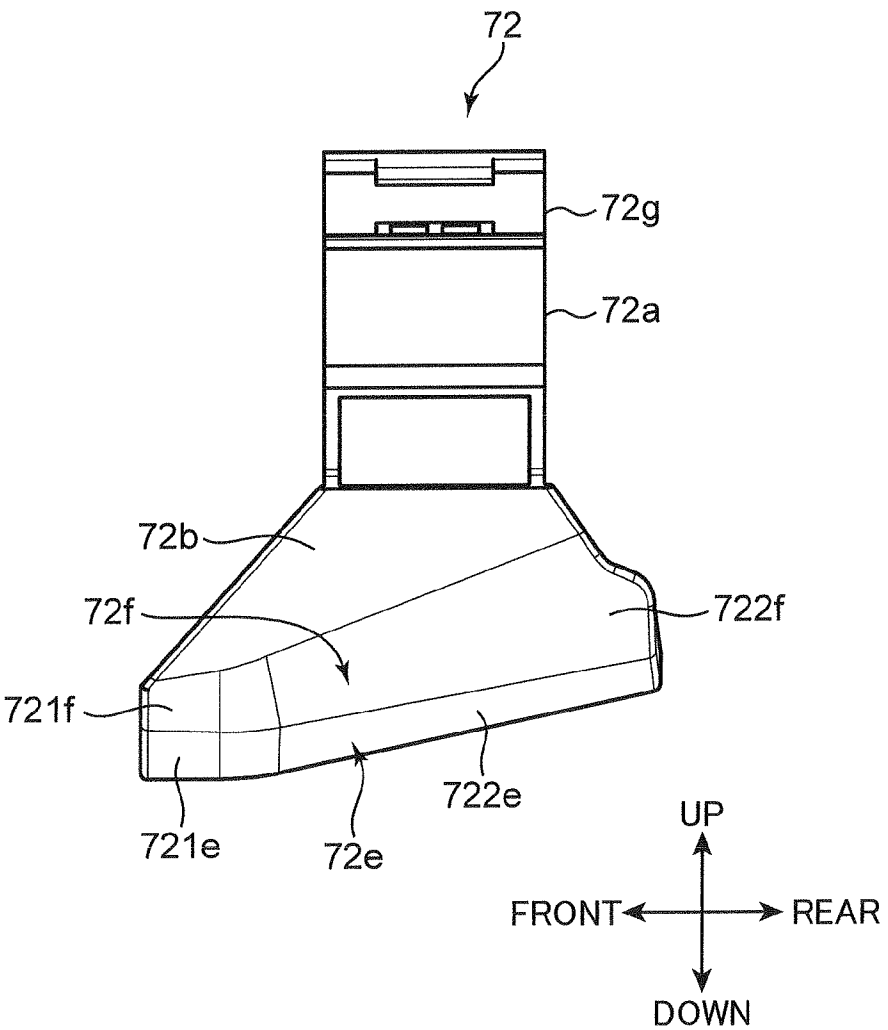
FIG. 10A is a rear view of the second pressing member.

FIG. 7 is a perspective view of the first pressing member 71, FIG. 8A is a front view of the first pressing member 71, and FIG. 8B is a side view of the first pressing member 71. Further, FIG. 9 is a perspective view of the second pressing member 72, FIG. 10A is a front view of the second pressing member 72, and FIG. 10B is a side view of the second pressing member 72.

The first pressing member 71 and the second pressing member 72 are disposed on the downstream side of the discharge rollers 124 and of the driven rollers 126, which serve as a discharge portion, in the sheet discharge direction at positions respectively corresponding to both ends of a sheet in a sheet width direction (front and rear directions in FIG. 4) orthogonal to the sheet discharge direction. Further, the first pressing member 71 and the second pressing member 72 are shiftable between the hanging posture, in which the first pressing member 71 and the second pressing member 72 hang from the axis of pivotal movement thereof (pivot shaft 73*a*, 74*a*) above the discharge path in such a manner as to block the discharge path, and the retracted posture, in which the first pressing member 71 and the second pressing member 72 are pivotally moved in the sheet discharge direction about the axis of pivotal movement thereof for opening the discharge path.

Referring to FIGS. 7 to 8B, the first pressing member 71 has an arm portion 71*a*, a side portion 71*b*, a bottom portion 71*e*, a curved portion 71*f*, and an engaging portion 71*g*. The bottom portion 71*e* includes a horizontal region 711*e* and an inclined surface 712*e*. The side portion 71*b* and the curved portion 71*f* are surfaces facing the discharge portion when the first pressing member 71 is in the hanging posture, and protruding into the discharge path. The bottom portion 71*e* is a surface continuing to a lower end of the side portion 71*b* and extending toward downstream in the sheet discharge direction.

The arm portion 71*a* is a rectangular member in transverse section of right and left directions, and extending in up and down directions. The engaging portion 71*g* is formed at one end of the arm portion 71*a*. The engaging portion 71*g* engages with the pivot shaft 73*a* of the first attachment auxiliary member 73. The pivot shaft 73*a*, and the rotary shaft 124*a* of the discharge rollers 124 are parallel to each other. When the engaging portion 71*g* engages with the pivot shaft 73*a*, the arm portion 71*a* is pivotally movable about the axis of the pivot shaft 73*a*.

In the following, the direction of an axis about which the arm portion 71*a* is pivotally moved is called as a pivot axis direction (front and rear directions), and a direction orthogonal to the pivot axis direction and to the longitudinal direction (up and down directions) of the arm portion 71*a* is called as a pivot direction (left and right directions; corresponding to the sheet discharge direction). FIGS. 7 to 10B show a state that the first pressing member 71 and the second pressing member 72 are set to the hanging posture to be described later, with the first pressing member 71 and the second pressing member 72 being mounted on the sheet discharge device 17. Front and rear directions, left and right directions, and up and down directions in FIGS. 7 to 10B respectively correspond to the orientations of the image forming apparatus 1 shown in FIG. 1.

The bottom portion 71*e* is formed on the end of the arm portion 71*a* on the side opposite to the engaging portion 71*g*. As shown in FIG. 8A, the bottom portion 71*e* includes the horizontal region 711*e* extending in parallel to the pivot axis direction and inclined with respect to the pivot direction, and the inclined surface 712*e* continuing forwardly of the horizontal region 711*e* with an inclination with respect to the pivot axis direction and with respect to the pivot direction.

The side portion 71*b* is formed on the right surface of the arm portion 71*a*. The side portion 71*b* continues to the bottom portion 71*e* via the curved portion 71*f*. The curved portion 71*f* includes a horizontal curved portion 711*f* configured to continuously connect between the horizontal region 711*e* and the side portion 71*b*, and an inclined curved portion 712*f* configured to continuously connect between the inclined surface 712*e* and the side portion 71*b*.

As shown in FIG. 4, the arrangement position of the first pressing member 71 is a position corresponding to a rear end of a sheet to be discharged by the discharge rollers 124. The first attachment auxiliary member 73 is attached to the frame 70 in a state that the engaging portion 71*g* of the first pressing member 71 engages with the pivot shaft 73*a*.

When the first attachment auxiliary member 73 is attached to the frame 70, the pivot shaft 73*a* is disposed at a position higher than the nip portion N between the discharge rollers 124 and the driven rollers 126. Further, the first pressing member 71 is set to the hanging posture, in which the first pressing member 71 hangs from the pivot shaft 73*a* by the weight thereof, with the bottom portion 71*e* being directed downwardly.

When the first pressing member 71 is in the hanging posture, the bottom portion 71*e* is disposed at a position lower than the nip portion N. Further, when the first pressing member 71 is in the hanging posture, the side portion 71*b* is disposed to face the nip portion N, and the side portion 71*b* is disposed at such a position as to block the discharge path of a sheet to be discharged from the nip portion N.

When the first pressing member 71 is in the hanging posture, the horizontal region 711*e* is made substantially horizontal in the sheet width direction (front and rear directions) orthogonal to the sheet discharge direction, and is inclined downwardly toward downstream (left direction) in the sheet discharge direction. The horizontal region 711*e* continues to the inclined surface 712*e* on the side corresponding to the middle part of the sheet in the sheet width direction.

When the first pressing member 71 is in the hanging posture, the inclined surface 712*e* is inclined upwardly with an angle of about 10 degrees to 15 degrees with respect to the horizontal region 711*e* toward the middle part of the sheet (forwardly) in the sheet width direction with respect to the sheet width direction (front and rear directions). Further, the inclined surface 712*e* is also inclined downwardly toward downstream (left direction) in the sheet discharge direction when the first pressing member 71 is in the hanging posture.

Referring to FIGS. 9 to 10B, the second pressing member 72 has an arm portion 72*a*, a side portion 72*b*, a bottom portion 72*e*, a curved portion 72*f*, and an engaging portion 72*g*. The bottom portion 72*e* includes a horizontal region 721*e* and an inclined surface 722*e*. The curved portion 72*f* includes a horizontal curved portion 721*f* configured to continuously connect between the horizontal region 721*e* and the side portion 72*b*, and an inclined curved portion 722*f* configured to continuously connect between the inclined surface 722*e* and the side portion 72*b*.

The second pressing member 72 is different from the first pressing member 71 in the following points. The arrangement position of the second pressing member 72 is a position corresponding to a front end of a sheet to be discharged by the discharge rollers 124 in the drawings. The second attachment auxiliary member 74 is attached to the electrostatic remover 76 in such a manner that the engaging portion 74*b* engages with the electrostatic remover 76 from right side in a state that the engaging portion 72*g* of the second pressing member 72 engages with the pivot shaft 74*a* (see FIG. 4). Further, the bottom portion 72*e* of the second pressing member 72 is configured such that the inclined surface 722*e* is continued rearwardly of the horizontal region 721*e*. In other words, the first pressing member 71 and the second pressing member 72 are symmetrical to each other with respect to front and rear directions.

When the second pressing member 72 is in the hanging posture, the horizontal region 721*e* is made substantially horizontal in the sheet width direction (front and rear directions) orthogonal to the sheet discharge direction, and is inclined downwardly toward downstream (left direction) in the sheet discharge direction. The horizontal region 721*e* continues to the inclined surface 722*e* on the side corresponding to the middle part of the sheet in the sheet width direction.

When the second pressing member 72 is in the hanging posture, the inclined surface 722*e* is inclined upwardly with an angle of about 10 degrees to 15 degrees with respect to the horizontal region 721*e* toward the middle part of the sheet (rearwardly) with respect to the sheet width direction (front and rear directions). Further, the inclined surface 722*e* is also inclined downwardly toward downstream (left direction) in the sheet discharge direction when the second pressing member 72 is in the hanging posture.

The configuration of the second pressing member 72 is substantially the same as the first pressing member 71 in the points other than the above, and accordingly, description on the configuration of the second pressing member 72 regarding the other points is omitted herein.

Next, an operation of the thus-configured image forming apparatus 1 is described. At first, after an image is formed on a sheet by the image forming assembly 30, the sheet carrying the image is conveyed to the nip portion N between the discharge rollers 124 and the driven rollers 126 along the main conveying path 50A. Then, the discharge rollers 124 are driven and rotated by an unillustrated drive motor, whereby the sheet nipped between the discharge rollers 124 and the driven rollers 126 is conveyed in the sheet discharge direction.

FIGS. 11A to 13B are explanatory diagrams for describing an operation of the first pressing member 71 and the second pressing member 72. Since the operation of the second pressing member 72 is substantially the same as that of the first pressing member 71, the illustration of the second pressing member 72 is omitted in FIGS. 11A to 11C, and in FIGS. 13A and 13B, and the description on the second pressing member 72 referring to these drawings is omitted herein.

Figure 11A:
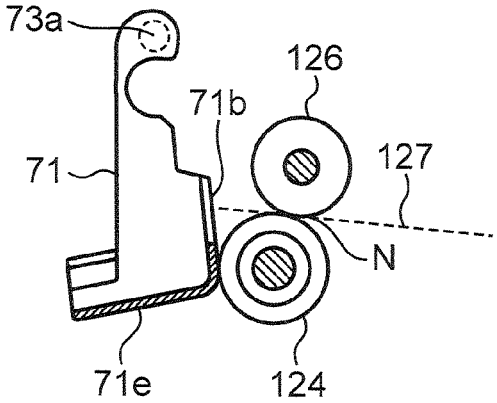
FIGS. 11A to 11C are explanatory diagrams for describing an operation of the first pressing member and the second pressing member.

As shown in FIG. 11A, the first pressing member 71 is disposed to block the discharge path 127 of a sheet when the first pressing member 71 is in the hanging posture, in which the first pressing member 71 hangs from the pivot shaft 73*a* by the weight thereof.

Figure 11B:
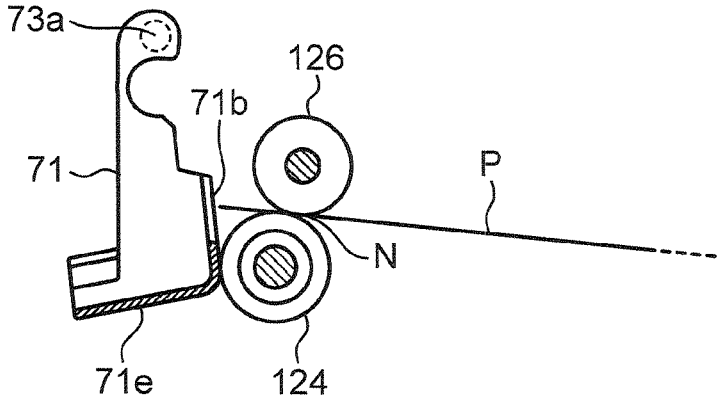
Figure 11C:
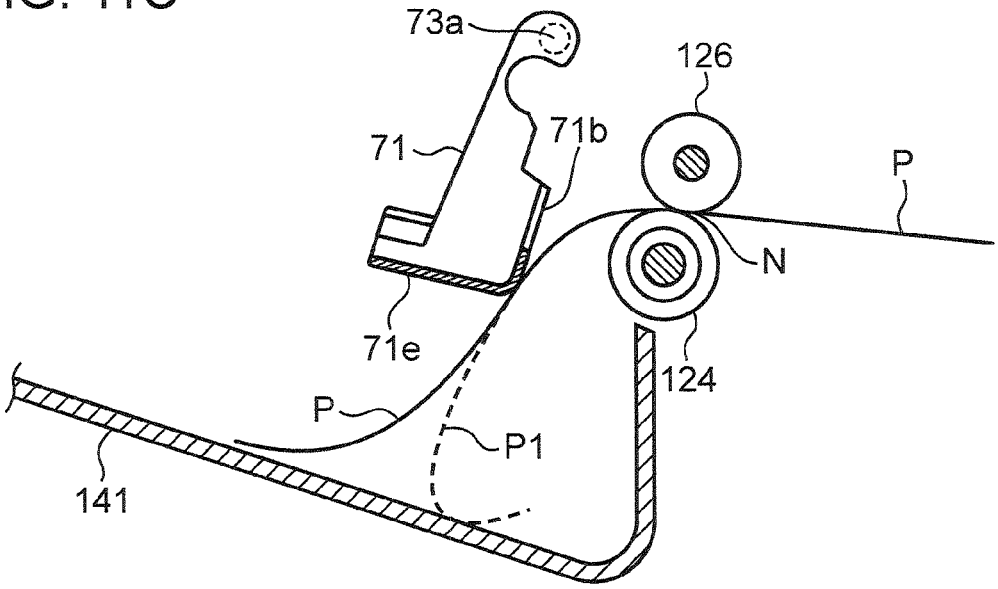

When a sheet P nipped between the discharge rollers 124 and the driven rollers 126 is conveyed in the sheet discharge direction in a state that the first pressing member 71 is in the hanging posture, as shown in FIG. 11B, the leading end of the sheet P comes into contact with the side portion 71*b*. When the leading end of the sheet P comes into contact with the side portion 71*b*, as shown in FIG. 11C, the side portion 71*b* is pressed by the sheet P. By the application of the pressing force, the first pressing member 71 is pivotally moved about the axis of the pivot shaft 73*a*, whereby the first pressing member 71 is shifted to the retracted posture. In the case where the sheet P has a relatively large stiffness, in some of the cases, the first pressing member 71 in the retracted posture may be disposed at a position further above the example shown in FIG. 11C.

The sheet P is conveyed toward the sheet tray 141, while being pressed downwardly by the weight of the first pressing member 71 during sliding contact with the bottom portion 71*e* and with the curved portion 71*f* of the first pressing member 71 in the retracted posture.

Figure 12A:
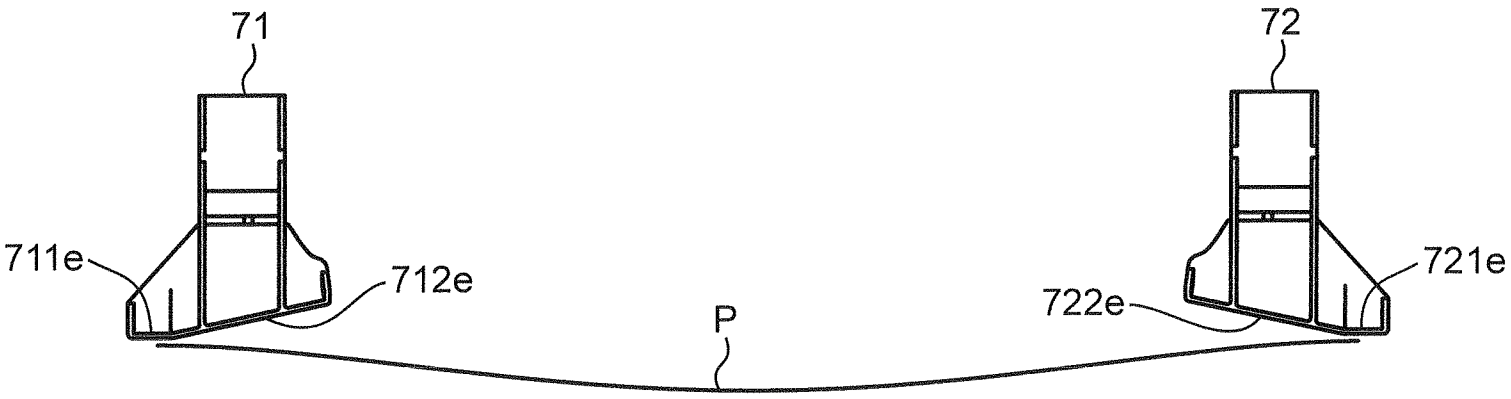
FIGS. 12A and 12B are explanatory diagrams for describing an operation of the first pressing member and the second pressing member.
Figure 12B:
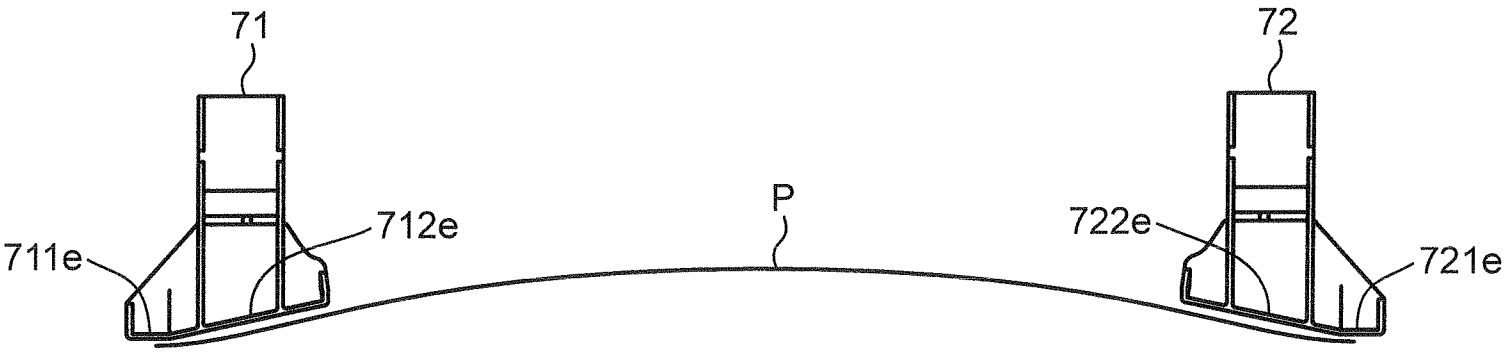

FIGS. 12A and 12B are explanatory diagrams showing a state that the sheet P comes into sliding contact with the first pressing member 71 and with the second pressing member 72 in the retracted posture, when viewed from the downstream side in the sheet discharge direction. FIG. 12A shows a case, in which the sheet P downwardly bulges (with upward curls), and FIG. 12B shows a case, in which the sheet P upwardly bulges (with downward curls).

In the case where the sheet P has upward curls, as shown in FIG. 11C, the sheet P is conveyed onto the lower-located sheet tray 141, with the upwardly flexed widthwise ends of the sheet P being pressed downwardly by the horizontal region 711*e* (or the horizontal curved portion 711*f*) of the first pressing member 71, and by the horizontal region 721*e* (or the horizontal curved portion 721*f*) of the second pressing member 72. As a result of the conveyance, the upward curls of the sheet P placed on the sheet tray 141 are reduced.

Further, the widthwise ends of the sheet P that has come into contact with the side portions 71*b* and 72*b* are received by the inclined surface 712*e*, the inclined curved portion 712*f*, the inclined surface 722*e*, and the inclined curved portion 722*f*, and the sheet P is guided to the horizontal region 711*e*, the horizontal curved portion 711*f*, the horizontal region 721*e*, and the horizontal curved portion 721*f*. Thus, the sheet P is smoothly guided to the horizontal region 711*e*, the horizontal curved portion 711*f*, the horizontal region 721*e*, and the horizontal curved portion 721*f*, without a likelihood that the widthwise ends of the curled sheet P may be stuck on the first pressing member 71 and on the second pressing member 72. Accordingly, it is possible to reduce the upward curls of the sheet P, while suppressing a likelihood that the sheet P may be stuck on the first pressing member 71 and on the second pressing member 72.

On the other hand, in the case where the sheet P has downward curls, the sheet P comes into sliding contact with the horizontal region 711*e* (or the horizontal curved portion 711*f*) and the inclined surface 712*e* (or the inclined curved surface 712*f*) of the first pressing member 71, and with the horizontal region 721*e* (or the horizontal curved portion 721*f*) and the inclined surface 722*e* (or the inclined curved portion 722*f*) of the second pressing member 72 along the curled portions of the sheet P. As a result of the above operation, as shown in FIG. 11C, it is possible to convey the sheet P onto the lower-located sheet tray 141, while appropriately pressing the sheet P downwardly by the horizontal region 711*e* (or the horizontal curved portion 711*f*), the inclined surface 712*e* (or the inclined curved portion 712*f*), the horizontal region 721*e* (or the horizontal curved portion 721*f*), and the inclined surface 722*e* (or the inclined curved portion 722*f*), without application of an excessive pressing force to the curled portions of the sheet P.

During the above operation, as with the case of upward curls, the widthwise ends of the sheet P that has come into contact with the side portions 71*b* and 72*b* are received by the inclined surface 712*e*, the inclined curved portion 712*f*, the inclined surface 722*e*, and the inclined curved portion 722*f*, and the sheet P is guided to the horizontal region 711*e*, the horizontal curved portion 711*f*, the horizontal region 721*e*, and the horizontal curved portion 721*f*. Accordingly, the sheet P is smoothly conveyed onto the lower-located sheet tray 141, while being appropriately pressed downwardly by the bottom portion 71*e* (or the curved portion 71*f*) of the first pressing member 71, and by the bottom portion 72*e* (or the curved portion 72*f*) of the second pressing member 72, without a likelihood that the widthwise ends of the curled sheet P may be stuck on the first pressing member 71 and on the second pressing member 72.

Now, let us assume a case, in which the inclined surface 712*e* (or the inclined curved portion 712*f*) of the first pressing member 71, and the inclined surface 722*e* (or the inclined curved portion 722*f*) of the second pressing member 72 are not inclined upwardly in the width direction of the sheet P, but the surface 712*e* and the surface 722*e* extend horizontally. In this case, concerning a downwardly pressing force to the sheet P by the first pressing member 71 and by the second pressing member 72, the force to be exerted in the case where the sheet P has downward curls (see FIG. 12B) is larger than the force to be exerted in the case where the sheet P has upward curls (see FIG. 12A).

Then, if the downwardly pressing force to the sheet P is excessively increased, the conveying direction of the sheet P1 is inclined excessively downwardly, as indicated by the dotted line in FIG. 11C. As a result of the above operation, the sheet P1 comes into contact with the sheet tray 141, with the leading end of the sheet P1 facing upstream of the sheet tray 141. This may result in curl up of the sheet P1 on the sheet tray 141.

On the other hand, the sheet discharge device 17 is configured such that the inclined surface 712*e* (or the inclined curved portion 712*f*) of the first pressing member 71, and the inclined surface 722*e* (or the inclined curved portion 722*f*) of the second pressing member 72 are inclined upwardly toward the middle part of the sheet P in the sheet width direction. This configuration makes it possible to reduce a downwardly pressing force to the sheet P having downward curls. As a result of the above operation, it is possible to convey the sheet P onto the sheet tray 141 without curl up of the sheet P on the sheet tray 141.

Further, unlike a configuration of the background art, in which a sheet is pressed by the ends of a plate-shaped member, the first pressing member 71 and the second pressing member 72 press the sheet P in a planar manner. Accordingly, it is possible to reduce excessive and local application of a pressing force onto a portion to be pressed. This makes it possible to suppress poor image formation resulting from sliding contact with an image surface.

Figure 13A:
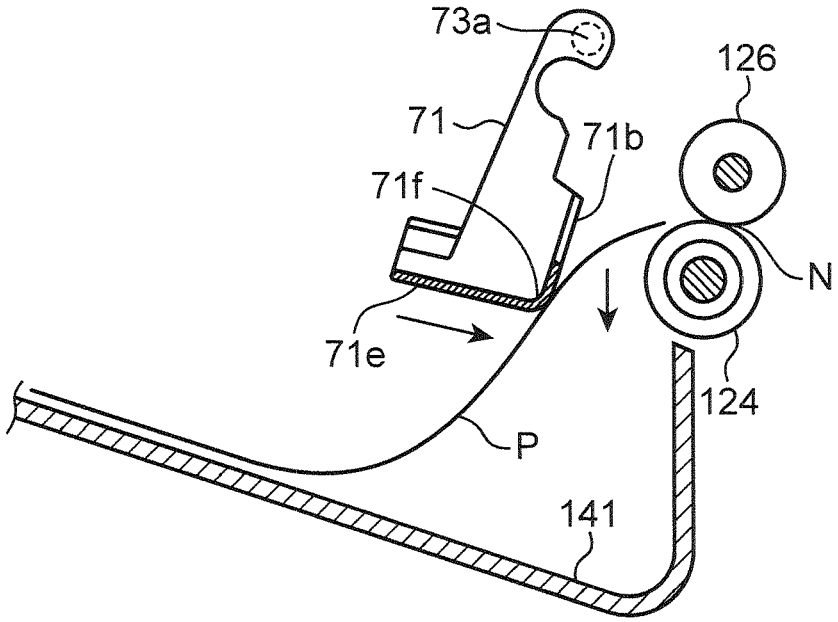
FIGS. 13A and 13B are explanatory diagrams for describing an operation of the first pressing member and the second pressing member.
Figure 13B:
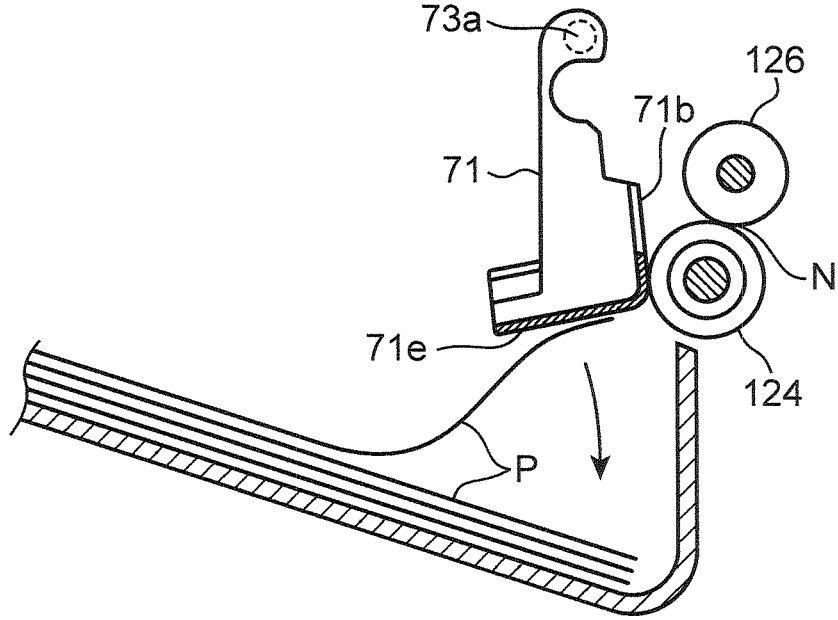
Figure 14:
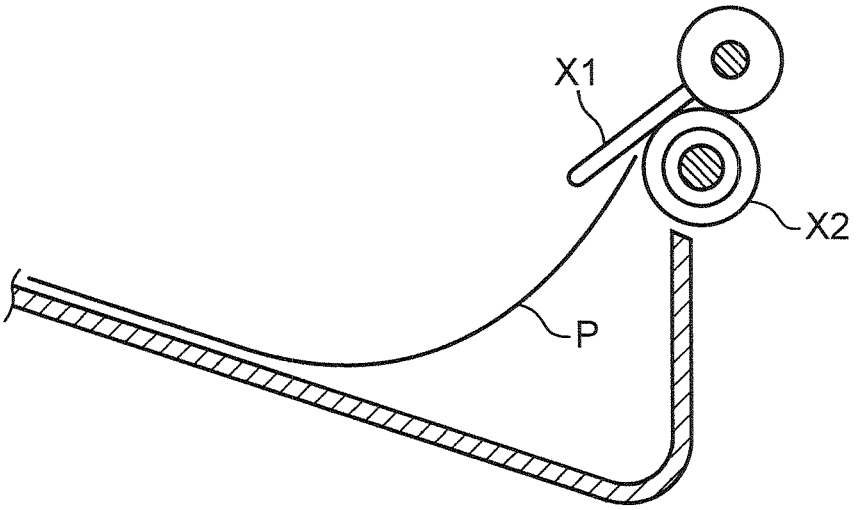
PRIOR ART FIG. 14
FIG. 14 is an explanatory diagram relating to the background art.

FIG. 13A shows a state immediately after the trailing end of the sheet P has left the nip portion N between the discharge rollers 124 and the driven rollers 126 as a result of a discharging operation by the discharge rollers 124 and the driven rollers 126. In this state, since the conveying force to the sheet P is lost, the first pressing member 71 is pivotally moved by the weight thereof and swings back to the hanging posture. In this example, since the bottom portion 71*e* is disposed at a position lower than the nip portion N, the trailing end of the sheet P is pushed downwardly by the bottom portion 71*e* during a pivotal movement of the first pressing member 71 to return to the hanging posture thereof (see FIG. 13B).

During the above movement when the first pressing member 71 is in the hanging posture, the bottom portion 71*e* is inclined downwardly toward downstream in the sheet discharge direction. Accordingly, in shifting the first pressing member 71 from the retracted posture to the hanging posture, the bottom portion 71*e* facing the upper surface of the sheet P presses the upper surface of the trailing end of the sheet P. As a result of the above operation, it is possible to guide the trailing end of the sheet P toward a base end side (right end side) of the sheet tray 141, while suppressing a conveying force of conveying the trailing end of the sheet P in the sheet discharge direction. Thus, it is possible to align the trailing end of the sheet P on the base end side.

As described above, disposing the bottom portion 71*e* of the first pressing member 71 at a position lower than the nip portion N makes it possible to securely set the trailing end of the sheet P to a position lower than the nip portion N, even in the case where the trailing end of the sheet P is curled upwardly. Accordingly, it is possible to reduce a likelihood that the sheet P may be placed on the sheet tray 141 in a state that the trailing end of the sheet P is faced upwardly. Thus, it is possible to reduce a likelihood that the leading end of a sheet P to be discharged next may be placed beneath the preceding sheet P that has been placed on the sheet tray 141.

As described above, according to the image forming apparatus 1 and the sheet discharge device 17 of the embodiment, it is possible to discharge a sheet P onto the sheet tray 141 in a satisfactory manner, no matter in which direction the sheet P is curled.

A preferred embodiment of the image forming apparatus 1 according to the present disclosure has been described as above. The present disclosure is not limited to the configuration of the embodiment, but may be modified as follows.

(1) In the embodiment, when the first pressing member 71 and the second pressing member 72 are in the hanging posture, the bottom portion 71*e* and the bottom portion 72*e* are disposed at a position lower than the nip portion N. In the case where the sheet P is discharged with a large inclination upwardly, however, it is not necessary to dispose the bottom portion 71*e* and the bottom portion 72*e* at a position lower than the nip portion N when the first pressing member 71 and the second pressing member 72 are in the hanging posture. The advantage of the present disclosure can be obtained, as far as the bottom portion 71*e* and the bottom portion 72*e* are disposed at a position lower than the tangent line passing through the nip portion N. However, it is preferable to dispose the bottom portion 71*e* and the bottom portion 72*e* at a position lower than the nip portion N when the first pressing member 71 and the second pressing member 72 are in the hanging posture, because the above configuration is advantageous in securely pressing the trailing end of the sheet P downwardly.

(2) In the embodiment, when the first pressing member 71 and the second pressing member 72 are in the hanging posture, the bottom portion 71*e* and the bottom portion 72*e* are inclined downwardly toward downstream in the sheet discharge direction. The bottom portion 71*e* and the bottom portion 72*e* may not be necessarily inclined downwardly as described above.

However, as described above, it is preferable to configure such that the bottom portion 71*e* and the bottom portion 72*e* are inclined downwardly toward downstream in the sheet discharge direction when the first pressing member 71 and the second pressing member 72 are in the hanging posture, because the above configuration is advantageously applied to each of a sheet P having an upward curl and a sheet having a downward curl. Specifically, in the case where the sheet P has an upward curl, it is possible to press the curled portions downwardly by the slopes of the bottom portion 71*e* and the bottom portion 72*e*. On the other hand, in the case where the sheet P has a downward curl, it is possible to avoid excessive pressing of the curled portions by the slopes of the bottom portion 71*e* and the bottom portion 72*e*, whereby it is possible to prevent curl up of the sheet P on the sheet tray 141.

(3) In the embodiment, the bottom portions 71*e* and 72*e* respectively include the horizontal regions 711*e* and 721*e*. Alternatively, the bottom portions 71*e* and 72*e* may not be provided with the horizontal regions 711*e* and 721*e* respectively, but be configured such that the inclined surfaces 712*e* and 722*e* press an end portion of the sheet P downwardly.

However, it is preferable to configure such that the bottom portions 71*e* and 72*e* are respectively provided with the horizontal regions 711*e* and 721*e*, because applying a force to the sheet P in vertical direction by the horizontal regions 711*e* and 721*e* makes it possible to effectively press the sheet P downwardly.

(4) In the embodiment, the first pressing member 71 and the second pressing member 72 are respectively provided with the curved portion 71*f* and the curved portion 72*f*. Alternatively, the first pressing member 71 and the second pressing member 72 may not be provided with the curved portion 71*f* and the curved portion 72*f* respectively.

However, it is preferable to configured such that the first pressing member 71 and the second pressing member 72 are respectively provided with the curved portion 71*f* and the curved portion 72*f*, because the sheet P in contact with the side portions 71*b* and 72*b* is allowed to be smoothly guided downwardly by the curved portions 71*f* and 72*f*. Further, the above configuration is preferable because inclining the curved portions 71*f* and 72*f* upwardly toward the middle position (middle part of the sheet P) between the first pressing member 71 and the second pressing member 72 during sliding contact of the sheet P with the curved portions 71*f* and 72*f* makes it possible to suppress excessive pressing of the sheet P having a downward curl.

(5) In the embodiment, the curved portion 71*f* includes the horizontal curved portion 711*f* and the inclined curved portion 712*f*, and the curved portion 72*f* includes the horizontal curved portion 721*f* and the inclined curved portion 722*f*. Alternatively, the curved portion 71*f* may not include the horizontal curved portion 711*f* and the inclined curved portion 712*f*, and the curved portion 72*f* may not include the horizontal curved portion 721*f* and the inclined curved portion 722*f*.

However, the configuration of the embodiment is preferable because applying a force to the sheet P in vertical direction during sliding contact of the sheet P with the curved portions 71*f* and 72*f* by the horizontal curved portions 711*f* and 721*f* makes it possible to effectively press the sheet P downwardly. Further, the above configuration is preferable because inclining the inclined curved portions 712*f* and 722*f* upwardly toward the middle position (middle part of the sheet P) between the first pressing member 71 and the second pressing member 72 during sliding contact of the sheet P with the curved portions 71*f* and 72*f* makes it possible to suppress excessive pressing of the sheet P having a downward curl.

(6) In the embodiment, the first pressing member 71 and the second pressing member 72 are shiftable to the hanging posture by the weight thereof. Alternatively, the first pressing member 71 and the second pressing member 72 may be shiftable to the hanging posture by an elastic member such as a spring. However, it is preferable to configure such that the first pressing member 71 and the second pressing member 72 are shiftable to the hanging posture by the weight thereof, because the above configuration can be implemented with a simplified construction.

(7) In the embodiment, the first pressing member 71 and the second pressing member 72 are attached to the sheet discharge device by the first attachment auxiliary member 73 and by the second attachment auxiliary member 74. Alternatively, the sheet discharge device 17 may not be provided with the first attachment auxiliary member 73 and with the second attachment auxiliary member 74, but the first pressing member 71 and the second pressing member 72 may be directly attached to the sheet discharge device 17.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet discharge device for discharging a sheet onto a sheet tray on which the sheet is to be placed, comprising:

a discharge path along which the sheet is discharged onto the sheet tray;

a discharge portion disposed on the discharge path, and configured to discharge the sheet passing along the discharge path onto the sheet tray; and a pressing member disposed on a downstream side of the discharge portion in a sheet discharge direction, at a position corresponding to each of both ends of the sheet in a sheet width direction orthogonal to the sheet discharge direction, the pressing member being shiftable between a hanging posture, in which the pressing member hangs from an axis of pivotal movement thereof above the discharge path in such a manner as to block the discharge path, and a retracted posture, in which the pressing member is pivotally moved in the sheet discharge direction about the axis of pivotal movement thereof for opening the discharge path, wherein the pressing member has a first portion defined by an upper part of the pressing member and a second portion defined by a lower part of the pressing member when the pressing member is in the hanging posture, the first portion includes:

an arm portion having a rectangular shape and extending in an up and down direction, the arm portion including an engaging portion that engages rotatably with a pivot shaft, and a side surface defining a flat surface extending in the up and down direction on one side region of the arm portion and protruding into the discharge path when the pressing member is in the hanging posture;

the second portion includes:

a bottom surface defining a flat surface substantially perpendicular to the side surface and continuing to a lower end of the side surface and extending toward downstream in the sheet discharge direction, and a curved surface configured to connect continuously between the bottom surface and the side surface of the pressing member, and the bottom surface includes a horizontal surface extending in a substantially horizontal direction from an outer side edge of the pressing member to a middle part of the sheet in the sheet width direction and an inclined surface inclined upward from the horizontal surface to an inner side edge of the pressing member in the sheet with direction when the pressing member is in the hanging posture, the side surface is disposed at a position where a leading end of the sheet only comes into contact with the side surface when the pressing member is in the hanging posture, and the bottom surface is disposed at a position where the bottom surface pushes a trailing end of the sheet downwardly and the horizontal surface comes into sliding contact with a widthwise end of the sheet when the pressing member is in the hanging posture.

2. The sheet discharge device according to claim 1, wherein the pressing member is shifted from the hanging posture to the retracted posture by a pressing force applied to the pressing member when a leading end of the sheet discharged from the discharge portion comes into contact with the side surface for allowing the bottom surface to press the leading end of the sheet downwardly, and the pressing member is shifted from the retracted posture to the hanging posture when a trailing end of the sheet is discharged from the discharge portion for allowing the bottom surface to press the trailing end of the sheet downwardly.

3. The sheet discharge device according to claim 1, wherein the discharge portion includes a first roller and a second roller configured to convey the sheet while nipping the sheet therebetween, and the bottom surface is disposed at a position lower than a nip portion between the first roller and the second roller when the pressing member is in the hanging posture.

4. The sheet discharge device according to claim 1, wherein the inclined surface of the bottom surface is further inclined downwardly toward downstream in the sheet discharge direction when the pressing member is in the hanging posture.

5. The sheet discharge device according to claim 1, wherein the curved surface is configured to be inclined upwardly toward the middle part when the pressing member is in the retracted posture.

6. The sheet discharge device according to claim 1, wherein the second portion includes an inclined curved surface configured to continuously connect between the inclined surface and the side surface, and a horizontal curved surface configured to continuously connect between the horizontal surface and the side surface of the pressing member, and the inclined curved surface is configured to be inclined upward toward the middle part when the pressing member is in the retracted posture.

7. The sheet discharge device according to claim 1, wherein the pressing member is shiftable to the hanging posture by the weight thereof.

8. An image forming apparatus, comprising:

an image forming assembly configured to form an image on a sheet;

a sheet tray configured to have the sheet placed thereon; and a sheet discharge device configured to discharge the sheet having the image formed thereon by the image forming assembly onto the sheet tray, the sheet discharge device including:

a discharge path along which the sheet is discharged onto the sheet tray;

a discharge portion disposed on the discharge path, and configured to discharge the sheet passing along the discharge path onto the sheet tray; and a pressing member disposed on a downstream side of the discharge portion in a sheet discharge direction, at a position corresponding to each of both ends of the sheet in a sheet width direction orthogonal to the sheet discharge direction, the pressing member being shiftable between a hanging posture, in which the pressing member hangs from an axis of pivotal movement thereof above the discharge path in such a manner as to block the discharge path, and a retracted posture, in which the pressing member is pivotally moved about the axis of pivotal movement thereof in the sheet discharge direction for opening the discharge path, wherein the pressing member has a first portion defined by an upper part of the pressing member and a second portion defined by a lower part of the pressing member when the pressing member is in the hanging posture, the first portion includes:

an arm portion having a rectangular shape and extending in an up and down direction, the arm portion including an engaging portion that engages rotatably with a pivot shaft, and a side surface defining a flat surface extending in the up and down direction on one side region of the arm portion and protruding into the discharge path when the pressing member is in the hanging posture;

the second portion includes:

a bottom surface defining a flat surface substantially perpendicular to the side surface and continuing to a lower end of the side surface and extending toward downstream in the sheet discharge direction, and a curved surface configured to connect continuously between the bottom surface and the side surface of the pressing member, and the bottom surface includes a horizontal surface extending in a substantially horizontal direction from an outer side edge of the pressing member to a middle part of the sheet in the sheet width direction and an inclined surface inclined upward from the horizontal surface to an inner side edge of the pressing member in the sheet with direction when the pressing member is in the hanging posture, the side surface is disposed at a position where a leading end of the sheet only comes into contact with the side surface when the pressing member is in the hanging posture, and the bottom surface is disposed at a position where the bottom surface pushes a trailing end of the sheet downwardly and the horizontal surface comes into sliding contact with a widthwise end of the sheet when the pressing member is in the hanging posture.

9. The image forming apparatus according to claim 8, wherein the pressing member is shifted from the hanging posture to the retracted posture by a pressing force applied to the pressing member when a leading end of the sheet discharged from the discharge portion comes into contact with the side surface for allowing the bottom portion to press the leading end of the sheet downwardly, and the pressing member is shifted from the retracted posture to the hanging posture when a trailing end of the sheet is discharged from the discharge portion for allowing the bottom surface to press the trailing end of the sheet downwardly.

10. The image forming apparatus according to claim 8, wherein the discharge portion includes a first roller and a second roller configured to convey the sheet while nipping the sheet therebetween, and the bottom surface is disposed at a position lower than a nip portion between the first roller and the second roller when the pressing member is in the hanging posture.

11. The image forming apparatus according to claim 8, wherein an inclined surface of the bottom surface is a surface inclined downwardly toward downstream in the sheet discharge direction when the pressing member is in the hanging posture.

12. The image forming apparatus according to claim 8, wherein the curved surface is configured to be inclined upwardly toward the middle part when the pressing member is in the retracted posture.

13. The image forming apparatus according to claim 12, wherein the second portion includes an inclined curved surface configured to continuously connect between the inclined surface and the side surface, and a horizontal curved surface configured to continuously connect between the horizontal surface and the side surface of the pressing member, and the inclined curved surface is configured to be inclined upward toward the middle part when the pressing member is in the retracted posture.

14. The image forming apparatus according to claim 8, wherein the pressing member is shiftable to the hanging posture by the weight thereof.

15. The sheet discharge device according to claim 1, wherein:

the pressing member includes a first pressing member and a second pressing member, the first pressing member includes the side surface and the bottom surface with the horizontal surface and the inclined surface and also includes a first inclined curved surface configured to connect continuously between the inclined surface and the side surface of the first pressing member, and the second pressing member includes a second side surface defining a flat surface extending in the UP and down direction on another side region of a second arm portion of the second pressing member and protruding into the discharge path when the second pressing member is in the hanging posture, a second bottom surface defining a flat surface substantially perpendicular to the second side surface and continuing to a lower end of the second side surface and extending toward downstream in the sheet discharge direction, wherein the second bottom surface includes a second horizontal surface extending in a substantially horizontal direction from an outer side edge of the second pressing member to the middle part of the sheet in the sheet width direction and a second inclined surface inclined upward from the second horizontal surface to an inner side edge of the second pressing member in the sheet width direction when the second pressing member is in the hanging posture, wherein the second pressing member also includes a second inclined curved surface configured to connect continuously between the second inclined surface and the second side surface of the second pressing member, and the first and second inclined curved surfaces are inclined upward toward the middle part of the sheet, and widths of the first and second inclined curved surfaces become wider toward the middle part of the sheet.

* * * * *